United States Patent [19]

Kuramoto et al.

[11] Patent Number: 4,618,558

[45] Date of Patent: Oct. 21, 1986

[54] LIQUID DEVELOPER FOR USE IN ELECTROSTATIC PHOTOGRAPHY

[75] Inventors: Shinichi Kuramoto; Hajime Takanashi, both of Numazu, Japan

[73] Assignee: Ricoh Co., Ltd., Tokyo, Japan

[21] Appl. No.: 666,402

[22] Filed: Oct. 30, 1984

[30] Foreign Application Priority Data

Oct. 31, 1983 [JP] Japan ..... 58-204522

[51] Int. Cl.[4] ..... G03G 9/12

[52] U.S. Cl. ..... 430/115; 430/119

[58] Field of Search ..... 430/115, 117, 118, 119, 430/137, 138

[56] References Cited

U.S. PATENT DOCUMENTS 3,915,874 10/1975 Machida ..... 430/115

4,137,340 1/1979 Verlinden et al. ..... 430/97

4,413,048 11/1983 Landa ..... 430/119

*Primary Examiner*—John L. Goodrow

*Attorney, Agent, or Firm*—Flynn, Thiel, Boutell & Tanis

[57] ABSTRACT

A liquid developer for use in electrostatic photography which comprises further containing wax in toner particles consisting essentially of a colorant and a resin as well as mixing with and including among the wax-containing toner particles a filler for preventing transfer-crush comprising particles in the range of 10–20μ particle diameter 63.5 piece % or more, particles over 20μ particle diameter 6.5 piece % or less and particles not more than 10μ particle diameter 30 piece % or less is capable of forming high quality images, irrespective of whether the smoothness of a transfer paper used is high or low.

7 Claims, No Drawings

LIQUID DEVELOPER FOR USE IN ELECTROSTATIC PHOTOGRAPHY

BACKGROUND OF THE INVENTION (a) Field of the Invention

The present invention relates to a liquid developer for use in electrostatic photography, which developer contains wax and a filler for preventing transfer-crush.

(b) Description of the Prior Art

The wet developing method which comprises developing electrostatic latent images formed on electrophotographic sensitive materials, electrostatic recording materials and the like with a liquid developer (which normally comprises dispersing toner particles consisting essentially of a colorant and a resin in a highly insulating carrier liquid) is profitable in that the etching effect is small and so copied images of high resolving power can be obtained. The transfer method which comprises forming images on the above mentioned materials and thereafter transferring said images onto another substrate is profitable in that common paper and plastic film can be used as the transfer sheet, and so, the copies are easy to handle. Accordingly, it may be said preferable to form copies making use of the combination of the wet developing method with the transfer method. However, this system involves the questions that in case a transfer sheet of low smoothness is used, the solid area in the transfer image deteriorates in uniformity as copying is repeated, while in case a transfer sheet of high smoothness is used, the transfer image deteriorates in sharpness as copying is repeated.

Therefore, various proposals have usually been made concerning the liquid developer in order to solve these questions. For instance, it is known that wax should be contained in the toner particles for the purpose of improving the uniformity of the solid image and a spherical substance such as glass beads and a spacer such as polymethacrylate particles should be mixed with and included among the toner particles as the filler for preventing transfer-crush for the purpose of improving the sharpness of the transfer sheet (for instance, Japanese Laid Open Patent Application No. 34328/1974 corresponding to U.S. Pat. No. 3915874 discloses the use of the 0.5–15μ spherical substance and Japanese Laid Open Patent Application Nos. 178252/1982, 200049/1982 and 298351/1983 disclose that the spacer whose particle diameter is 20–70μ is used as a rule). However, these developers have merits and demerits respectively. The developer comprising the wax-containing toner particles can not achieve the effect of improving sharpness, while the developer which includes the filler for preventing transfer-crush therein can not obtain the uniformity of the solid image. In the latter developer, furthermore, in case the spherical substance is used, if the amount of the spherical substance used is in excess, and in case the spacer is used, if its particle diameter is too large, not only the effect of improving sharpness can not be obtained but also the deterioration in image density is brought about, and the image uniformity is sometimes reduced according to circumstances.

SUMMARY OF THE INVENTION

The object of the present invention is to provide a liquid developer for use in electrostatic photography, which developer is capable of obtaining copies of high image quality, irrespective of the high or low smoothness of the transfer paper used.

The liquid developer for use in electrostatic photography according to the present invention comprises dispersing toner particles consisting essentially of a colorant and resin in a highly insulating carrier liquid, wherein wax is further contained in said toner particles and a filler for preventing transfer-crush is mixed with and included among said wax-containing toner particles, said filler comprising 63.5 number %, or more, of particles having a particle diameter in the range of 10–20μ, 6.5 number %, or less, of particles having a particle diameter of over 20μ particle diameter, and 30 number %, or less, of particles having a particle diameter of not more than 10μ. The term "number %" is defined as meaning the percentage of the total number of particles of filler.

In this connection, it is to be noted that the particle size distribution of fine particles is expressed in terms of number % or vol.% or the combination thereof. The relation between number % and vol.% is denoted by the following formula: number $\% = 0.19 \times (\text{vol.}\%)^{1.18}$.

The reason why particle diameters of the filler for preventing transfer-crush have been defined as mentioned above will be given below. When the so-called fine powder of not more than 10μ is present in large amount, plenty of the filler becomes present on the photosensitive material on developing, whereby the image density is deteriorated, the particles effective for preventing transfer-crush are insufficient and so the sharpness is degraded. When the so-called coarse powder over 20μ increases, contrarily, poor transfer is caused and consequently the image density is deteriorated and a poor solid image is caused. Accordingly, it may be said to be desirable that all the filler for preventing transfer-crush ideally should be in the range of 10–20μ. However, it is inevitable that particles whose particle diameter is over 20μ or not more than 10μ will be present because the method for manufacturing particles and the method for classifying particles are not complete. Therefore, we have carried out various investigations to clarify that in case the particle diameter of the filler for preventing transfer-crush is mainly in the range of 10–20μ, and the particles over 20μ is 6.5 number % or less and the particles not more than 10μ is 30 number % or less, the aforesaid problems are not caused. The filler for preventing transfer-crush, if too much is used, deteriorates the image density because said filler is present on the photosensitive material, and, if too little is used, is unable to prevent transfer-crush to the full. Accordingly, it is preferable that the amount of the filler for preventing transfer-crush contained in the developer should be in the range of 0.01–2 wt.%. As the filler for preventing transfer-crush there can be enumerated inorganic fine particles such as glass beads, zinc oxide, titanium oxide, silica and the like; synthetic resin such as polymethacrylate (for instance, methyl polymethacrylate and ethyl polymethacrylate), unsaturated polyester, polyvinyl chloride, polystyrene, polycarbonate, epoxy resin and the like; particles (for instance, dry toner) comprising these resins and the colorants referred to afterwards (the amount of resin is about 60–99 wt.% and the amount of colorant is about 1–40 wt.%); and the like.

The ingredients constituting the toner particles according to the present invention are colorant, resin and wax.

As the colorant there can be enumerated carbon black (goods on the market include Printex G and V and Special Black 15, 4 and 4-B produced by Degusa Inc.; Mitsubishi #44, #30, MA-11 and MA-100 produced by Mitsubishi Carbon K.K.; Laven 30, 40, 1035, Conductex SC, Mogal L, Elftex 8, Legal 400, and the like produced by Cabot Co.), Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Lithol Fast Yellow 2G, Permanent Red 4R, Brilliant Fast Scarlet, Hansa Yellow, Lithol Red, Benzidine Yellow, Lake Red C, Lake Red D, Brilliant Carmine 6B, Permanent Red F5R, Pigment Scarlet 3B, Alkali Blue, Oil Blue, Oil Violet, Methyl Orange, Fast Red, Methyl Violet and the like.

As the resin there can be used those which have usually been used in the wet toner. For instance, there can be enumerated graft copolymers of the vinyl monomer represented by the formula:

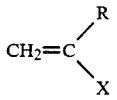

(1)

[wherein, R stands for H or $CH_3$ and X stands for $COOC_nH_{2n+1}$ (n=6–20)]
with glycidyl methacrylate, glycidyl acrylate, acrylic acid, methacrylic acid, vinylpyridine and the like, and copolymers of said graft copolymers with the vinyl monomer represented by the formula:

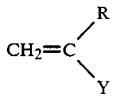

(2)

[wherein, R stands for H or $CH_3$ and Y stands for $COOC_nH_{2n+1}$ (n=1–5)] or the formula:

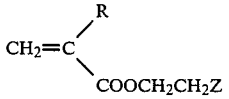

(3)

(wherein, R stands for H or $CH_3$, and Z stands for $N(CH_3)_2$, $N(C_2H_5)_2$ and $CH_2CH_2OH$.)

It is desirable that the amount of the vinyl monomer represented by the general formula (1) contained in the resin should be in the range of 30–95 wt.%.

The above mentioned resin, as occasion demands, may be used concurrently with natural resin such as ester gum, hardened rosin and the like; natural resin-modified thermo-setting resin such as natural resin-modified maleic resin, natural resin-modified phenol resin, natural resin-modified polyester resin, natural resin-modified pentaerythritol resin, epoxy resin and the like; and so forth.

The wax on the market includes the following:

| Maker | Brand name | Softening point (°C.) |
|---|---|---|
| Union Carbide | DYNI | 102 |
| | DYNF | 102 |
| | DYNH | 102 |
| | DYNJ | 102 |

-continued

| Maker | Brand name | Softening point (°C.) |
|---|---|---|
| | DYNK | 102 |
| Monsanto | ORLIZON 805 | 116 |
| | ORLIZON 705 | 116 |
| | ORLIZON 50 | 126 |
| Phillips | MARLEX 1005 | 92 |
| Du Pont | ALATHON-3 | 103 |
| | ALATHON-10 | 96 |
| | ALATHON-12 | 84 |
| | ALATHON-14 | 80 |
| | ALATHON-16 | 95 |
| | ALATHON-20 | 86 |
| | ALATHON-22 | 84 |
| | ALATHON-25 | 96 |
| Sanyo Kasei | Sunwax 131-P | 108 |
| | Sunwax 151-P | 107 |
| | Sunwax 161-P | 111 |
| | Sunwax 165-P | 107 |
| | Sunwax 171-P | 105 |
| Allied Chemical | AC Polyethyrene 6 & 6A | 102 |
| | AC Polyethyrene 615 | 105 |
| Eastman Chemical | N-10 | 111 |
| | N-11 | 108 |
| | N-12 | 113 |
| | N-14 | 106 |
| | N-34 | 103 |
| | N-45 | 118 |
| | C-10 | 104 |
| | C-13 | 110 |
| | C-15 | 102 |
| | C-16 | 106 |
| | E-10 | 106 |
| | E-11 | 106 |
| | E-12 | 112 |
| | E-14 | 104 |
| | E-15 | 100 |
| Mitsui Sekiyu Kagaku | 110P | 100 |
| | 220P | 113 |
| | 220MP | 113 |
| | 320MP | 114 |
| | 410MP | 122 |
| | 210MP | 120 |
| | 310MP | 122 |
| | 405MP | 126 |
| | 200P | 128 |
| | 4202E | 108 |
| | 4053E | 111 |
| BASF | OA WAX | 93–96 |
| Petrolite | BARECO 500 | 86 |
| | BARECO 655 | 102 |
| | BARECO 1000 | 113 |
| | BARECO 2000 | 125 |
| | E 730 | 93 |
| | E 2018 | 117 |
| | E 2020 | 117 |
| | E 1040 | 105 |
| | Petronauba C | 90.5 |
| | Petronauba C-36 | 90.5 |
| | Petronauba C-400 | 104.5 |
| | Petronauba C-7500 | 97.8 |
| Hoechst | PE 520 | 118–123 |
| | PE 130 | 122–127 |
| | PED 121 | 113–118 |
| | PED 136 | 107–112 |
| | PED 153 | 115–120 |
| | PED 521 | 103–108 |
| | PED 522 | 100–105 |
| | PED 534 | 98–105 |

In order to make the toner contain the above mentioned wax therein, the following methods and combinations thereof can be employed. Such methods include (1) a method comprising kneading the wax, as-powdered, together with the colorant and the resin in the presence of a small amount of carrier liquid (normally, the petroleum type aliphatic hydrocarbon as referred to afterwards is used therefor); (2) a method comprising heating and dissolving the wax in a non-aqueous solvent (normally, toluene, a petroleum type aliphatic hydrocarbon or its halide is used therefor), thereafter quenching same for separating and dispersing the wax in fine particle form and kneading this dispersion together with the colorant and the resin, or after the aforesaid method (1) is effected, heating the carrier liquid for dissolving the wax once and then quenching for separating and dispersing the wax in fine particle form; (3) a method comprising kneading the aqueous dispersion of the colorant and the non-aqueous solvent dispersion under heating and reduced pressure conditions for distilling out the solvent and water to thereby coat the colorant with wax and then kneading this wax-coated colorant together with the resin and, if necessary, the wax in the presence of a small amount of carrier liquid; and (4) a method comprising adding and dissolving wax in the process for the preparation of resin (said process being effected by heating) and kneading the obtained wax-containing resin together with a colorant in the presence of a small amount of carrier liquid, and the like. As kneading machines there can be used a kneader, an atritor, a ball mill, a kedy mill, a vibrating mill and the like. These steps can produce a wax-containing concentrated toner. The preferable amount of wax contained is 20–60 wt.% of the total amount of toner particles containing wax. When the amount of wax is small, toner layers do not contact on transferring and accordingly the recessed portion of a paper inferior in smoothness is not filled up on fixing. When the amount of wax is in excess, the obtained image is blurred.

The proper amounts of colorant, resin and solvent (or carrier liquid) used in the above concentrated toner are about 5–40 wt.%, about 5–40 wt.% and about 300–1,000 wt.% respectively against the total amount of the wax-containing toner particles.

The toner may be added with natural resin such as ester gum, hardened rosin and the like; natural resin-modified thermo-setting resin such as natural resin-modified maleic resin, natural resin-modified phenol resin, natural resin-modified polyester resin, natural resin-modified pentaerythritol resin; epoxy resin and the like in addition to the above components.

As the carrier liquid there may be used petroleum type aliphatic hydrocarbons such as cyclohexane, n-hexane, n-heptane, n-nonane, n-octane, isooctane, isododecane, ligroin and their mixtures (as the petroleum type aliphatic hydrocarbons on the market there may be enumerated Isoper E, G, H, L and K produced by Esso Standard Oil Co., Ltd., and Shellzol 71 and Solvesso 150 and the like produced by Shell Oil Co.)

The liquid developer according to the present invention may be prepared by diluting the thus obtained wax-containing concentrated toner about 5–10 times with a similar solvent or carrier liquid and further adding the filler for preventing transfer-crush thereto.

According to the present invention, a high image quality of copy can be obtained irrespective of high and low smoothness of the transfer paper used, because the toner particles contain wax therein and the filler for preventing transfer-crush has the above mentioned particle size distribution.

DESCRIPTION OF THE PREFERRED EMBODIMENTS

Next, the preparation example of the filler for preventing transfer-crush and the examples using the filler for preventing transfer-crush will be given. Part and % referred to herein are all by weight.

Preparation Example

Styrene monomer: 50 parts
Dispersant (Tween 80 produced by Kanto Kagaku K.K.): 1.5 parts
Polymerization initiator (A.C.H.N produced by Otsuka Kagaku K.K.): 0.4 part
Water: 500 parts These components were mixed together and held at 75° C. for 5 hours while stirring vigorously. Then, the thus obtained massive matters were removed from this mixture. The mixture was washed 5 times repeatedly and dried. Thereafter, same was treated using the zigzag classifier (100 MZR produced by Alpine Company) while changing the classifying conditions to thereby obtain samples of the filler for preventing transfer-crush.

TABLE 1

| | Content of 10–20μ | Content of less than 10μ | Content of more than 20μ | Average particle diameter per number* | Average particle diameter per volume* |
|---|---|---|---|---|---|
| No. 1 (Comparative Example) | 68.9 number % | 31.1 number % | 0 number % | 10.5μ | 12.6μ |
| No. 2 (Example) | 84.0% | 14.3% | 1.7% | 12.5μ | 14.9μ |
| No. 3 (Comparative Example) | 82.6% | 10.3% | 7.1% | 14.1μ | 17.5μ |

*Reference value

By repeating classification 6–7 times there was obtained a sample wherein all the particles were included within the particle diameter scope of 8.0–10.0μ. This sample was named No. 4. Classification was repeated so that No. 5 may have the particle diameter distribution of 10–13μ, No. 6 the particle diameter distribution of 13–16μ, No. 7 the particle diameter distribution of 16–20μ and No. 8 the particle diameter distribution of 20–25μ. Thus, a total of 8 samples were obtained.

EXAMPLE 1

50% Isopar-H dispersion of glycidyl methacrylatelauryl methacrylate-acrylic acid-methyl methacrylate copolymer: 40 parts
carbon black (Neospectra Mark II produced by columbia Co.): 13 parts
Alkali Blue (produced by Orient Kagaku K.K.): 2 parts
10% Isopar-H dispersion of OA WAX (produced by BASF Co., softening point 93°–96° C.): 250 parts These components were placed in a ball mill, dispersed for 72 hours, thereafter added with 360 parts of Isopar-H, and further dispersed for one additional hour. 140 parts of this concentrated toner was diluted with 750 parts of Isoper H. Thus, a developer was prepared. The aforesaid samples No. 1–3 were placed in this developer so as to be 0.05%, and subjected to image formation with INFOTEC 8032R (produced by Kalley Co.).

As the result, No. 2 and No. 3 produced superior images but No. 1 was inferior in sharpness (evaluated based on the resolving power) and low in image density as compared with No. 2. Likewise, No. 4–8 were evaluated. The obtained results were as shown in the folowing table.

TABLE 2

| | Image density | Resolving power |
|---|---|---|
| No. 4 (Comparative Example) | 1.08 | 5.6 lines/mm |
| No. 5 (Example) | 1.18 | 6.3 lines/mm |
| No. 6 (Example) | 1.20 | 7.2 lines/mm |
| No. 7 (Example) | 1.15 | 7.9 lines/mm |
| No. 8 (Comparative Example) | 1.08 | 7.9 lines/mm |

It can be seen from this table that No. 5–7 are superior in image density and No. 5–8 are superior in sharpness. Accordingly, it can be seen important that the particle diameter of the filler for preventing transfer-crush should be limited within the scope of 10–20μ in order to enhance sharpness without lowering image density.

EXAMPLE 2

500 g of water and 50 g of carbon black (Mogal A produced by Cabot Co.) were fully stirred in a flusher. Thereafter, 150 g of wax (DYNF, produced by Union Carbide Co.) was added thereto, and kneaded at 150° C. for 2 hours. 250 g of carbon tetrachloride was further added thereto and same was kneaded for 2 hours. Thereafter, this mixture was subjected to reduced pressure for removal of water and carbon tetrachloride therefrom, and pulverized in a sweat mill to thereby obtain a wax-coated pigment.

Further, 80 g of isooctane was heated to 100° C. in a flask and a mixture of 60 g of stearyl methacrylate, 20 g of methyl methacrylate, 10 g of maleic acid, 30 g of wax (DYNF produced by Union Carbide Co.) and 2 g of azobisisobutyronitrile was dropped in the flask for 2 hours and stirred. Further, 280 g of isooctane and 0.1 g of pyridine were added thereto, and said mixture was heated at 90° C. for 6 hours to thereby obtain a wax-containing resin.

Next, 40 parts of the above mentioned wax-coated pigment, 80 parts of the above mentioned wax-containing resin and 180 parts of isooctane were dispersed for 48 hours in a ball mill. Thereafter, said dispersion was added with 300 parts of isooctane and dispersed for 1 hour to thereby obtain a concentrated toner. 250 parts of said toner was taken out and diluted with 1000 parts of isooctane. Thus, a developer was obtained.

Samples No. 1–No. 3 were put in this developer as in Example 1 for the purpose of image formation. No. 2 formed a superior image, but No. 1 was somewhat inferior in sharpness and inferior in image density. The contents of these samples were changed, but the obtained results were the same as obtained in Example 1.

EXAMPLE 3

The exactly same procedure as Example 1 except that the wax used in Example 1 was replaced by 310 MP (softening point: 122° C.) produced by Mitsui Sekiyu Kagaku K.K. In the case of using a paper inferior in smoothness (for instance, a gilbert bond paper and the like) like a paper for use in typing, it was observed somewhat low in image density and large image uniformity as compared with Example 1, but in the case of using other transfer sheets there were obtained images substantially equal to Example 1.

We claim:

1. In a liquid developer for use in electrophotography which comprises a dispersion of toner particles and filler particles in a highly electrically insulating carrier liquid, said toner particles consisting essentially of colorant and resin and having wax contained therein, said filler particles being effective for preventing crushing of the developed image during transfer, the improvement which comprises: said filler particles consist essentially of 63.5 number % or more of filler particles having a particle diameter in the range of 10–20μ, 6.5 number % or less of filler particles having a particle size of over 20μ and 30 number % or less of filler particles having a particle size of not more than 10μ.

2. A developer according to claim 1 wherein the amounts of colorant, resin and wax are 5–40 wt.%, 5–40 wt.% and 20–60 wt.%, respectively, in the wax-containing toner particles, and the amount of the filler particles for preventing transfer-crush is 0.01–2 wt.% based on the developer.

3. A developer according to claim 1 wherein said filler particles are selected from the group consisting of glass beads, zinc oxide, titanium oxide, silica, polymethacrylates, unsaturated polyesters, polyvinyl chloride, polystyrene, polycarbonate, epoxy resin and particles comprising a resin and a colorant.

4. A developer according to claim 1 wherein said resin is selected from the group consisting of a binary copolymer of a vinyl monomer represented by the formula:

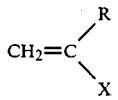

(1)

wherein R stands for H or $CH_3$, and X stands for $COOC_nH_{2n+1}$ (n=6–20) and at least one kind of monomer selected from the group consisting of glycidyl methacrylate, glycidyl acrylate, acrylic acid, methacrylic acid and vinylpyridine; and a ternary copolymer of the aforesaid two kinds of monomers and a monomer represented by the general formula (2) or (3):

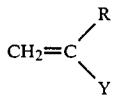

(2)

wherein R stands for H or $CH_3$, and Y stands for $COOC_nH_{2n+1}$ (n=1–5) or

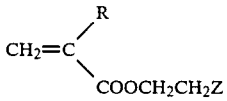

(3)

R stands for H or $CH_3$, and Z stands for $N(CH_3)_2$, $N(C_2H_3)_2$ and $CH_2CH_2OH$.

5. A developer according to claim 4 wherein the content of the vinyl monomer represented by the general formula (1) in the resin is 30–95 wt.%.

6. A developer according to claim 1 wherein the wax is coated on the colorant.

7. A developer according to claim 1 wherein the wax is contained in the resin.

* * * * *